US008737650B2

(12) United States Patent
Pedersen

(10) Patent No.: US 8,737,650 B2
(45) Date of Patent: May 27, 2014

(54) SYSTEM COMPRISING A PORTABLE ELECTRONIC DEVICE WITH A TIME FUNCTION

(75) Inventor: Michael Syskind Pedersen, Smørum (DK)

(73) Assignee: Oticon A/S, Smorum (DK)

( * ) Notice: Subject to any disclaimer, the term of this patent is extended or adjusted under 35 U.S.C. 154(b) by 210 days.

(21) Appl. No.: 13/455,834

(22) Filed: Apr. 25, 2012

(65) Prior Publication Data

US 2012/0275628 A1 Nov. 1, 2012

Related U.S. Application Data

(60) Provisional application No. 61/478,959, filed on Apr. 26, 2011.

(30) Foreign Application Priority Data

Apr. 26, 2011 (EP) ..... 11163700

(51) Int. Cl.
*H04R 25/00* (2006.01)

(52) U.S. Cl.
USPC ..... 381/315; 381/312

(58) Field of Classification Search
USPC ..... 381/312–315, 320–321
See application file for complete search history.

(56) References Cited

U.S. PATENT DOCUMENTS

| | | | |
|---|---|---|---|
| 5,065,321 | A | 11/1991 | Bezos et al. |
| 2002/0044669 | A1 | 4/2002 | Meyer et al. |
| 2004/0116151 | A1 | 6/2004 | Bosch et al. |
| 2006/0023904 | A1 | 2/2006 | Fischer |
| 2007/0009124 | A1 | 1/2007 | Larsen |
| 2009/0154743 | A1 | 6/2009 | Lundh et al. |
| 2010/0067723 | A1 | 3/2010 | Bergmann et al. |
| 2011/0033071 | A1 | 2/2011 | Larsen |

FOREIGN PATENT DOCUMENTS

| | | | |
|---|---|---|---|
| EP | 1 981 253 | A1 | 10/2008 |
| WO | WO 2009/135872 | A1 | 11/2009 |

OTHER PUBLICATIONS

European Search Report issued for European Application No. 11163700.5 on Sep. 20, 2011.

*Primary Examiner* — Suhan Ni
(74) *Attorney, Agent, or Firm* — Buchanan Ingersoll & Rooney PC

(57) ABSTRACT

A portable electronic device and an auxiliary device each having an interface allowing the establishment of a communication link between them, at least to be able to transmit data representative of a status information from the auxiliary device to the portable electronic device, and-a method of of establishing a measure of an absolute elapsed time in a listening device. The problem is solved in that the portable electronic device has a timing unit for determining a time interval and a memory for storing data, and wherein the auxiliary device has a master timing unit for providing a signal representative of the present time, and wherein the system is adapted to transfer a signal representative of the present time from the auxiliary device to the portable electronic device and to store it in the memory.

20 Claims, 3 Drawing Sheets

SYSTEM COMPRISING A PORTABLE ELECTRONIC DEVICE WITH A TIME FUNCTION

TECHNICAL FIELD

The present application relates to a portable electronic device comprising a local energy source, e.g. a listening device, in particular to the provision of an absolute time indication in such device. The disclosure relates specifically to a system comprising a portable electronic device and an auxiliary device, the portable electronic device and the auxiliary device each comprising an interface allowing the establishment of a communication link between them, at least to be able to transmit data representative of a status information from the auxiliary device to the portable electronic device. The application furthermore relates to a method of establishing a measure of an absolute elapsed time in a portable electronic device.

The disclosure may e.g. be useful in applications where low power consumption is an important issue, e.g. in listening devices, such as hearing aids, headsets, ear phones, active ear protection systems, etc.

BACKGROUND ART

In portable electronic devices, e.g. listening devices, that are turned on and off according to need, in particular battery driven devices, e.g. to conserve power, an account of absolute time elapsed from a given start time (including the time where the device has been turned off) may be difficult to estimate with an appropriate precision in the device without a (power consuming) real time clock circuit.

Some processing algorithms need an estimate of a real time elapsed, which is longer than a typical time of operation (uptime) of the device in question.

An uptime clock for measuring a time in which the device is in operation, and/or a power-up counter for counting a number of power-ups of device may be used to provide an estimate of a real time elapsed. An estimate of a real time elapsed may be based on the uptime multiplied by a predetermined factor, depending on the application of the device in question. Alternatively an estimate of a real time elapsed may be based on the number of power-ups multiplied by a predetermined time-value, depending on the application of the device in question, cf. e.g. US 2009/0154743 A1. These estimates are, however, subject to a substantial uncertainty due to the variance in use of the device from person to person and/or over time (e.g. from day to day).

US 2002/0044669 A1 describes a hearing aid adapted for detecting whether it is located in the immediate vicinity of an external transmitter with and thereby automatically choosing a hearing aid program depending on the external transmitter. In addition, the current time of day and the day of the week may influence the choice of the active hearing aid program.

US 2006/0023904 A1 describes a hearing aid adapted for emitting a voice signal to announce the current time of day, Preferably only the voice signal for the current time of day is saved in the hearing aid and to constantly update this voice signal by means of an external transmitter, preferably a remote controller. In this way, less memory space is thus required in the hearing aid for the time announcement.

DISCLOSURE OF INVENTION

It is proposed to provide an auxiliary device with a built-in clock. The auxiliary device is physically separate from the portable electronic device and adapted to transfer time information to the portable electronic device. The auxiliary device may be a stand-alone device or e.g. be integrated with a battery charger, a cell phone, an audio gateway, an FM transmitter or a storage box or other device which the portable electronic device is expected to occasionally encounter. An internal clock of the portable electronic device can thereby be adjusted every time the portable electronic device is located near (the or) a matching auxiliary device. The term 'when the portable electronic device is located near the (or an) auxiliary device' is in the present context taken to mean whenever the two devices are able to communicate with each other (e.g. within an operational range of communication of a wireless link between them or when the two devices are electrically connected, e.g. via a galvanic connection).

This has the advantage that the daily use and non-use pattern can be estimated. A further advantage is that an absolute elapsed time (extending over a continuous time of operation of the device) including down-time of the device, where the device is in a non-operational state (e.g. turned off) can be estimated. Algorithms or detectors needing information about elapsed time extending over more than a normal time of operation of the device, e.g. more than 8 hours or more than one day can thereby receive a more reliable input.

The time synchronization with the portable electronic device can be established through a wired connection, e.g. where the auxiliary device form part of a charger or it can be established via wireless connection, e.g. where the auxiliary device form part of a storage box or an audio gateway or a cellular telephone or the like.

An object of the present application is to make available a system and a method wherein an improved absolute time estimate is provided in a portable electronic device. It is an object of embodiments of the disclosure to provide an improved estimate of a time interval in a portable electronic device, said time interval being larger than an operating time of the portable electronic device from a power-on-time to a power-off-time.

Objects of the application are achieved by the invention described in the accompanying claims and as described in the following.

A system comprising a portable electronic device:

An object of the application is achieved by a system comprising a portable electronic device and an auxiliary device, the portable electronic device and the auxiliary device each comprising an interface allowing the establishment of a communication link between them, at least to be able to transmit data representative of a status information from the auxiliary device to the portable electronic device, wherein the portable electronic device comprises a timing unit for determining a time interval and a memory for storing data, and wherein the auxiliary device comprises a master timing unit for providing a signal representative of the present time, and wherein the system is adapted to transfer said signal representative of the present time from the auxiliary device to the portable electronic device and to store it in said memory.

This has the advantage that an elapsed time, including a time where the portable electronic device has been turned off, can be estimated by the device itself.

Preferably, the portable electronic device is adapted for monitoring and storing an operating time from a power-on-time to a power-off-time of operation of the portable electronic device.

Preferably, the system is adapted to transfer a signal representative of the present time from the auxiliary device to the portable electronic device and to store it in said memory when the portable electronic device (or devices in case of a binaural system) is connected to the auxiliary device (e.g. according to a predefined scheme) or at the request of a user, e.g. via a user interface on the auxiliary device or on the listening device. Thereby the daily use and non-use pattern of the portable electronic device can be estimated.

In an embodiment, the signal representative of the present time is transferred automatically. Alternatively it may be transferred at the request of the user via a user interface. In an embodiment, the portable electronic device and/or the auxiliary device comprises a user interface adapted for allowing such initiation of the transfer of the signal representative of the present time.

Preferably a measure of the absolute time elapsed from said reference start time is provided by the portable electronic device, e.g. by the timing unit.

An estimate of the daily use and non-use pattern of the portable electronic device may e.g. include estimates of accumulated use (where the portable electronic device is in normal use (powered on)) and non-use (where the portable electronic device is NOT in normal use (powered off)) pattern. It may further include a number of times within a given time interval the portable electronic device has been powered on (and off), average use and non-use times, etc.

Preferably, the memory is a non-volatile memory.

Preferably a reference start time is stored in the memory of the portable electronic device. In an embodiment, the reference start time is stored in a memory of the portable electronic device during an initialization and/or a customization procedure (e.g. a fitting procedure of a listening device, e.g. a hearing aid). In an embodiment, a reference start time is stored in the memory of the portable electronic device by the auxiliary device during a specific initialization procedure (e.g. a first encounter of the portable electronic device with an auxiliary device, e.g. a pairing procedure authorizing the two devices to exchange data). In an embodiment, the reference start time is representative of, such as equal to, the present time at the time of storage of the start time in the device in question. In an embodiment, the reference start time corresponds to an initial time of operational use of the portable electronic device.

In an embodiment, the system is adapted to provide that a linking procedure of the communication link between the auxiliary and portable electronic device comprises an identification of a predefined security key in at least one of the devices, e.g. in the portable electronic device, e.g. in both devices. In an embodiment, the predefined security key is a predefined security key of the auxiliary device, e.g. in the form of a number of encrypted or non-encrypted bits. The complexity of the security key (including its length) can advantageously be adapted to the level of security of the application in question. An auxiliary device and a portable electronic device are said to be paired or matched, if they have been provided with corresponding security keys.

In an embodiment, the portable electronic device is adapted to store in the memory a present time received from the auxiliary device as a last update of the current time (termed an 'update time'). In an embodiment, the portable electronic device is adapted to erase a previous value of the last update of the current time when a newer value of the present time has been received. In an embodiment, the listening device is adapted to store a number $N_m$ of subsequently received present time values in the memory as the latest updates of the current time. In an embodiment, the listening device is adapted to erase the oldest of the $N_m$ stored latest updates of the current time when a new present time value is received from the auxiliary device. In an embodiment, the reference time is the oldest of the update times stored in the memory. In an embodiment, the reference time is the last stored update time.

Preferably, the portable electronic device is adapted to monitor and store in the memory an estimate of the accumulated operating time of the portable electronic device (e.g. the time the portable electronic device has been turned on and being in a functional state, e.g. the time that the battery voltage has been sufficiently large for the portable electronic device to operate) relative to said reference start time and/or to one of said previously stored latest update time(s). An estimate of the accumulated operating time from a given start time is a summation of individual time intervals of operation (i.e. the 'on-time' of the portable electronic device) from that start time. In an embodiment, the portable electronic device is adapted to determine a relative operating time $T_{op,r}$ ($0 \leq T_{opr,r} \leq 1$), e.g. as the accumulated operating time over a real time interval divided by the real time interval. This figure can e.g. be used to compensate a time constant determined based on the operating time of the device for the non-operating time of the device where the device has been turned off (e.g. by multiplying the time constant in question with the relative operating time $T_{op,r}$). To account for small actual use times (relative operating times close to 0), a compensation algorithm such as $MAX[T_{op} \cdot T_{op,r}; T_{min}]$ may be used, where $T_{op}$ is a parameter (e.g. a time constant) estimated during normal operating use (assuming a continuous on-time) and $T_{min}$ is a minimum value of the parameter in question. In an embodiment, the real time interval is counted from the reference start time to the latest update time. In an embodiment, the real time interval is counted from an older update time to the latest update time. In an embodiment, the real time interval is larger than or equal to one day, e.g. larger than or equal to one week, e.g. larger than or equal to two weeks. In an embodiment, the real time interval is estimated as $\alpha \cdot rT_{prev} + (1-\alpha) \cdot rT_{cur}$, where $\alpha$ is a fading constant between 0 and 1, e.g. equal to 0.5 and $rT_{prev}$ and $rT_{cur}$ are the previous and current real time estimates, respectively.

In an embodiment, the portable electronic device is adapted to estimate an absolute time elapsed based on said start time and/or said previously stored update time(s). In an embodiment, the portable electronic device is adapted to estimate an absolute time elapsed from a given absolute point in time, e.g. from said start time or from one of said previously stored update tirne(s) to a later present time.

In an embodiment, the portable electronic device is adapted to estimate an absolute time span wherein the portable electronic device has been in a non-operational state from a given absolute point in time, e.g. from said start time or from one of said previously stored update time(s), and from an estimate of the accumulated time of operation of the portable electronic device relative to said given absolute point in time. The time span may e.g. be estimated up to a stored update time, e.g. to the present time (e.g. the last update time).

In an embodiment, an absolute point in time is defined by a time of day and a date. In an embodiment, the date is specified as a day-month-year. In an embodiment, the date is specified as a number of days from a predefined start date. In an embodiment, a time of the day is specified as an indication of the time elapsed (e.g. the number of hours or minutes or seconds) from a predefined time of the day, e.g. from midnight. In an embodiment, the time elapsed is defined as a number of hours or as a number minutes or as a number of seconds or as combination thereof.

In an embodiment, the auxiliary device forms part of a communication device, e.g. a cellular telephone or an audio transmitter (e.g. an FM transmitter). In an embodiment, the auxiliary device forms part of an audio gateway device adapted for receiving a multitude of audio signals (e.g. from an entertainment device, e.g. a TV or a music player, from a telephone apparatus, e.g. a mobile telephone, or from a computer, e.g. a PC) and adapted for selecting and/or combining an appropriate one of the received audio signals (or combination of signals) for transmission to the portable electronic device, e.g. a listening device. In an embodiment, the auxiliary device forms part of a charging station (e.g. for charging a rechargeable battery of the portable electronic device(s)) and/or a storage box for one or more (e.g. two) portable electronic devices or a remote control for the portable electronic device.

In an embodiment, the auxiliary device is adapted to receive a signal representative of the present time from another device, e.g. from a cell phone or from a radio time signal (e.g. DCF77 or MSF). In an embodiment, the auxiliary device comprises a real time clock circuit and a battery ensuring a constant functioning of the clock. Preferably the auxiliary device is adapted to provide that the signal representative of the present time does not change with changing time zones and/or summer/winter time.

In an embodiment, the auxiliary device comprises a display and is adapted to show the present time generated or received by the auxiliary device in the display.

In an embodiment, the system is adapted to provide that the portable electronic device receives the signal representative of the present time from the auxiliary device via an intermediate device, where the auxiliary device and the intermediate device, and the intermediate device and the portable electronic device are adapted to be able to establish a communication link between them (e.g. a fully or partially wireless link), at least enabling a transmission of data representative of a present time from the auxiliary device to the portable electronic device. In an embodiment, the intermediate device comprises an audio gateway and/or a remote control. In an embodiment, the auxiliary device form part of a cell phone, transmitting the signal representative of the present time to the intermediate device. In an embodiment, the intermediate device comprises an audio gateway adapted to relay the signal representative of the present time from the auxiliary device to the portable electronic device. In an embodiment, the system comprises the intermediate device.

In an embodiment, the portable electronic device and/or the intermediate device comprises a display and is/are adapted to show an estimate of the present time based on a signal representative of the present time received from the auxiliary device in the display of device in question. In an embodiment, the portable electronic device and/or the intermediate device is/are adapted to display an estimate of the accumulated operating time of the portable electronic device. In an embodiment, the portable electronic device and/or the intermediate device is/are adapted to display an estimate of an absolute time elapsed. In an embodiment, the portable electronic device and/or the intermediate device is/are adapted to display an estimate of the relative operating time of the portable electronic device.

In an embodiment, the portable electronic device is a device comprising a local energy source, e.g. a battery, e.g. a rechargeable battery. In an embodiment, the portable electronic device is a low power device. The term 'low power device' is in the present context taken to mean a device whose energy budget is restricted, e.g. because it is a portable device comprising a local energy source of limited size (e.g. with a maximum capacity of 1000 mAh, such as 500 mAh), which—without being exchanged or recharged—is of limited duration (the limited duration being e.g. of the order of hours or days, e.g. max. 1 or 3 or 7 or 10 days (during normal operation of the device), such duration being limited compared to the expected life time of the device). In an embodiment, the energy source of the portable electronic device is removed of disconnected, when the portable electronic device is not in operational use (whereby data that are not stored in a non-volatile memory are lost). In an embodiment, the portable electronic device has a maximum outer dimension of the order of 0.15 m (e.g. a handheld entertainment device). In an embodiment, the portable electronic device has a maximum outer dimension of the order of 0.08 m (e.g. a head set). In an embodiment, the portable electronic device has a maximum outer dimension of the order of 0.04 m (e.g. a hearing instrument).

The portable electronic device and the auxiliary device each comprise an interface (including appropriate antenna and transceiver circuitry) to allow a communication link to be established between them, at least for transmitting information about the current time from the auxiliary device to the portable electronic device.

In an embodiment, the portable electronic device comprises an antenna and transceiver circuitry for wirelessly receiving a direct electric input signal. In an embodiment, the portable electronic device comprises a (possibly standardized) electric interface (e.g. in the form of a connector) for receiving a wired direct electric input signal. In an embodiment, the portable electronic device comprises demodulation circuitry for demodulating the received direct electric input to provide a direct electric input signal representing an audio signal and/or a control or status signal e.g. for setting an operational parameter (e.g. volume) and/or a processing parameter of the portable electronic device, possibly including said time information.

In general, a wireless link established between the auxiliary device and the portable electronic device can be of any type. In the present disclosure, the wireless link is used under power constraints in that at least one of the devices comprises a portable electronic (typically battery driven) device. In an embodiment, the wireless link is a link based on near-field communication, e.g. an inductive link based on an inductive coupling between antenna coils of the transmitter and receiver parts of the auxiliary and portable electronic devices, respectively. In another embodiment, the wireless link is based on far-field, electromagnetic radiation. In an embodiment, the communication via the wireless link is arranged according to a specific modulation scheme, e.g. an analogue modulation scheme, such as FM (frequency modulation) or AM (amplitude modulation) or PM (phase modulation), or a digital modulation scheme, such as ASK (amplitude shift keying), e.g. On-Off keying, FSK (frequency shift keying), PSK (phase shift keying) or QAM (quadrature amplitude modulation). In an embodiment, the communication between the devices is arranged to follow an analogue or a digital communication standard, e.g. wireless IEEE 802.11 or ZigBee or Bluetooth or DECT, or to follow a proprietary scheme.

In an embodiment, the portable electronic device comprises a portable entertainment device and/or a listening device, e.g. a hearing instrument, a headset, an active ear protection device or a combination thereof.

In an embodiment, the portable electronic device is adapted to provide a frequency dependent gain to compensate for a hearing loss of a user. In an embodiment, the portable electronic device comprises a signal processing unit for enhancing the input signals and providing a processed output signal.

In an embodiment, the system is adapted for providing a timing input to algorithms or detectors needing information about elapsed time extending over more than a time of operation of the portable electronic device, e.g. more than 8 hours or more than one day, such as more than 1 month, such as more than 6 months. In an embodiment, said timing input comprises an estimate of the absolute time elapsed from said reference start time to a present time.

In an embodiment, the portable electronic device is adapted to provide an estimate of the absolute time elapsed from a later point in time than the reference start time to the present time (or to a time earlier than the present time).

In an embodiment, the portable electronic device comprises an input transducer for converting an input sound to an electric input signal. In an embodiment, the portable electronic device comprises a directional microphone system, e.g. adapted to separate two or more acoustic sources in the local environment of the user wearing the portable electronic device. In an embodiment, the directional system is adapted to detect (such as adaptively detect) from which direction a particular part of the microphone signal originates. This can be achieved in various different ways as e.g. described in the prior art. In an embodiment, the directional microphone system comprises an algorithm for matching the two or more microphones as a function of time. In an embodiment, the algorithm for matching the two or more microphones is adapted to receive a measure (e.g. from the timing unit) of the absolute time elapsed from a given start time (e.g. the reference start time).

In an embodiment, the portable electronic device (e.g. a listening device), e.g. the signal processing unit, comprises an algorithm for estimating a parameter related to child growth, e.g. to the growth of an ear canal of the child over time. In an embodiment, the algorithm for estimating the growth of an ear canal of the child over time is used to estimate points in time, where a modification of parameters of the portable electronic device (e.g. a listening device, such as a hearing instrument), e.g. gain parameters, such as maximum power output (MPO), is appropriate (cf. e.g. US 2009/0154743 A1). In an embodiment, such modification is based on a measure of the absolute time elapsed from a given start time (e.g. the reference start time) provided by the portable electronic device (e.g. the timing unit). In an embodiment, the algorithm for estimating the growth of an ear canal of the child over time is used to estimate a parameter related to leakage of sound from an output transducer to an input transducer of the listening device.

In an embodiment, the listening device is adapted to issue an alarm signal related to a time.

In an embodiment, the listening device is adapted to issue an alarm signal when a predefined time has elapsed since a given absolute point in time, e.g. since said start time or from one of said previously stored update time(s). This may e.g. be used to indicate to a user a (future) point in time that is related to an absolute time. In an embodiment, the listening device is adapted to issue an alarm signal when the accumulated operating time is larger than a predefined accumulated operating time. This can e.g. be used to indicate an estimate of a time for changing of recharging the battery.

In an embodiment, the listening device comprises an acoustic dose estimator and is adapted to issue an alarm signal when a predefined accumulated acoustic does has been exceeded.

In an embodiment, the listening device comprises an output transducer for converting an electric signal to a stimulus perceived by the user as an acoustic signal. In an embodiment, the output transducer comprises a number of electrodes of a cochlear implant or a vibrator of a bone conducting hearing device. In an embodiment, the output transducer comprises a receiver (speaker) for providing the stimulus as an acoustic signal to the user.

In an embodiment, the listening device comprises an acoustic (and/or mechanical) feedback suppression system. In an embodiment, the listening device further comprises other relevant functionality for the application in question, e.g. compression, noise reduction, etc.

Use:

In an aspect, use of a system as described above, in the detailed description of 'mode(s) for carrying out the invention' and in the claims, is moreover provided.

In an embodiment, the system is used in a hearing aid system comprising one or more hearing instruments, e.g. in a binaural hearing aid system. In an embodiment, the system is used in a hearing aid system comprising an audio gateway.

A method:

A method of establishing a measure of an absolute elapsed time in a portable electronic device, the portable electronic device forming part of a system comprising the portable electronic device and an auxiliary device, the portable electronic device and the auxiliary device each comprising an interface allowing the establishment of a communication link between them, at least to be able to transmit data representative of a status information from the auxiliary device to the portable electronic device is furthermore provided by the present application. The method comprises

- providing in the auxiliary device a signal representative of the present time;
- transmitting said signal representative of the present time to the portable electronic device;
- receiving said signal representative of the present time in the portable electronic device;
- extracting and storing data representative of the present time in the portable electronic device;
- determining in the portable electronic device an absolute time interval based on said data representative of the present time received from the auxiliary device.

It is intended that the structural features of the system described above, in the detailed description of 'mode(s) for carrying out the invention' and in the claims can be combined with the method, when appropriately substituted by a corresponding process and vice versa. Embodiments of the method have the same advantages as the corresponding system.

In an embodiment, the method comprises storing a time reference in the portable electronic device, the time corresponding to an initial time of use of the portable electronic device (termed a reference start time).

The signal representative of the present time is preferably (automatically transmitted from the auxiliary device and) received in the portable electronic device when the portable electronic device is connected to the auxiliary device. Alternatively to an automatic transfer, the transfer may be initiated by a user (e.g. via a user interface on the portable electronic device and/or on the auxiliary device).

Preferably, the absolute time interval is determined in the portable electronic device based on the data representative of the present time received from the auxiliary device and/or the reference start time, including a measure of the absolute time elapsed from the reference start time.

In an embodiment, the method comprises monitoring and storing an operating time of the portable electronic time from a power-on-time to a power-off-time of operation. In an embodiment, the method comprises determining an accumulated operating time as a sum of individual operating times from a measurement start time (e.g. the reference start time) to a later time (e.g. the present time). In an embodiment, the method comprises determining an accumulated non-operating time from said accumulated operating time, said measurement start time, and said later time, e.g. said data representative of the present time. In an embodiment, the method comprises determining a relative operating time, e.g. as the accumulated operating time over a real time interval divided by the real time interval.

In an embodiment, a usage pattern of a particular user of the portable electronic device is determined by the portable electronic device, e.g. by determining a relative operating time on a daily basis. In an embodiment, such usage pattern is used to modify one or more parameter settings in the portable electronic device.

In an embodiment, one or more parameter settings of one or more algorithms in the portable electronic device are modified based on the determined usage pattern and/or on the absolute elapsed time.

Further objects of the application are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element or intervening elements may be present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The disclosure will be explained more fully below in connection with a preferred embodiment and with reference to the drawings in which.

The figures are schematic and simplified for clarity, and they just show details which are essential to the understanding of the disclosure, while other details are left out. Throughout, the same reference numerals are used for identical or corresponding parts.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

MODE(S) FOR CARRYING OUT THE INVENTION

Figure 1:
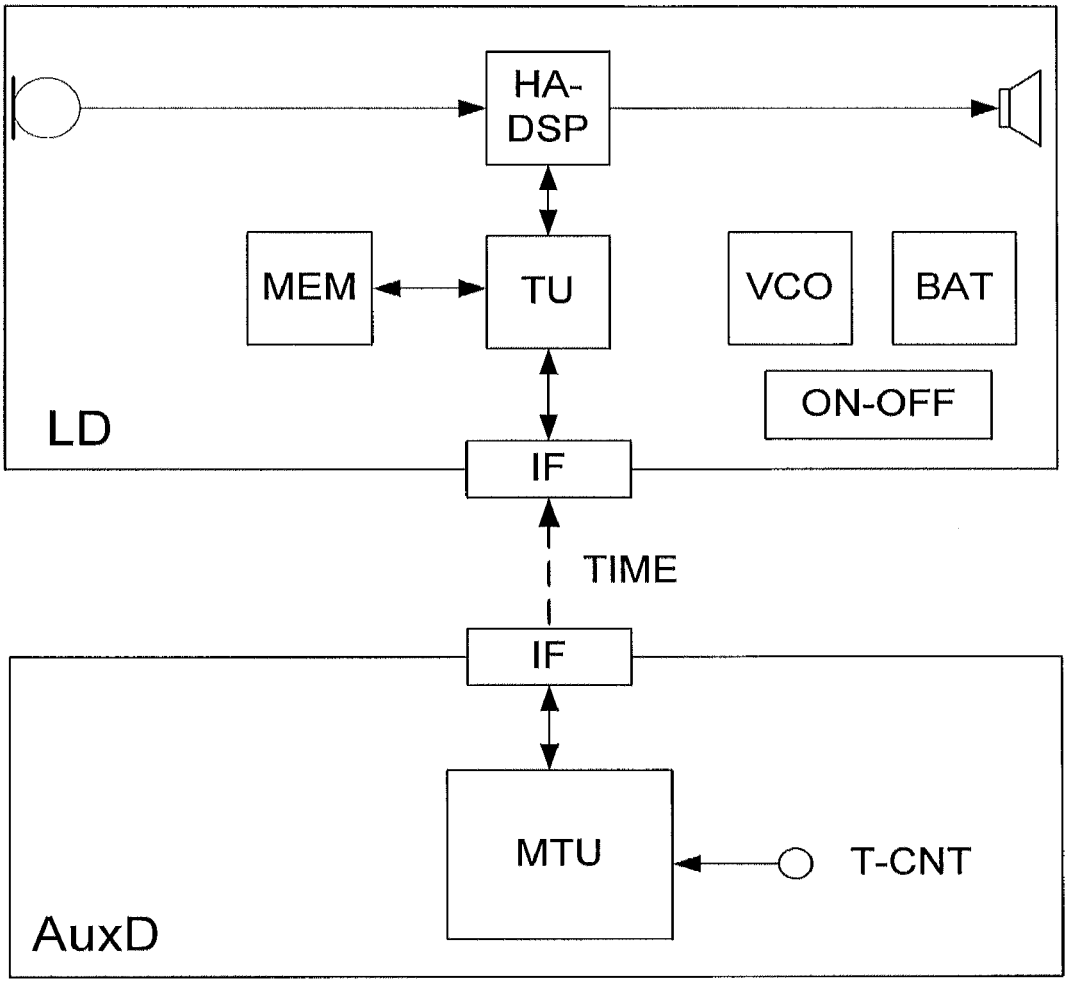
FIG. 1 shows a first embodiment of a system according to the present disclosure.

FIG. 1 shows a first embodiment of a system according to the present disclosure. FIG. 1 shows a portable listening device (LD) and an auxiliary device (AuxD), each comprising an interface (IF) allowing a communication link to be established between the two devices. The listening device, e.g. a hearing aid, comprises a forward path from an input transducer (microphone) to an output transducer (speaker), the forward path comprising a processing unit (HA-DSP) for applying a frequency dependent gain to the signal picked up by the input transducer (microphone) and providing an enhanced signal to the output transducer (speaker). The signal processing unit is e.g. adapted to adjust the signal to an impaired hearing of a user. The listening device further comprises a local energy source (e.g. a battery, such as a rechargeable battery, BAT) for supplying energy to the listening device, when in an operating state (where the listening device picks up a sound from the environment (e.g. a user's own voice), processes the input signal and provides a processed output sound to a user wearing the listening device). The listening device comprises a user interface (ON-OFF) for switching power to the device on or off, e.g. by switching relevant connections to the battery on and off, respectively. The user interface may take the form of a remote control or an activation element (e.g. a button) in or on the listening device. The listening device comprises a memory (MEM) for storing data and a timing unit (TU) for calculating time intervals based on data stored in the memory. The memory (MEM) of the listening device preferably comprises a non-volatile part for storing the time related data. The timing unit (TU) of the listening device (LD) is adapted for monitoring and storing in the memory (MEM) an operating time of the device from a power-on-time (where the device is switched on, i.e. 'powered up') to a power-off-time (where the device is switched off, i.e. 'powered down'). The timing unit (TU) is further adapted to monitor and store in the memory (MEM) an estimate of the accumulated time of operation of the listening device. The operating time may e.g. be determined by counting a number of clock cycles (of known duration in time) during a time of operation of the listening device. In an embodiment, the listening device comprises a clock generator (VCO) for generating a clock with a predefined time period. In an embodiment, the clock generator comprises a crystal oscillator with a predefined oscillating frequency. The auxiliary device comprises a master timing unit (MTU) adapted for providing (e.g. generating or receiving from another device) a signal representative of the current date and time. The auxiliary device is preferably adapted to use the coordinated universal time (UTC) as the current date and time. This prevents changes due to daylight saving time, different time zones, etc. The master timing unit (MTU) may e.g. be adapted to receive a radio signal containing the signal representative of the current date and time. Alternatively or additionally, the master timing unit (MTU) may comprise a timing circuit adapted for generating a precise master clock from which the signal representative of the current date and time can be extracted. Preferably, the auxiliary device comprises a long life energy source (e.g. a dedicated battery) that ensures a continuous power supply to the timing circuit. Preferably, the auxiliary device is adapted to prohibit a user from influencing the signal representative of the current date and time transmitted to the portable electronic device. The auxiliary device is adapted to transmit the signal representative of the present date and time (signal TIME) to the listening device, where it is received (possibly demodulated) and stored in the memory as an update time (and/or as a reference start time). The transmission of the signal representative of the present date and time may e.g. be controlled by a control signal (T-CNT), e.g. activated by a user (e.g. via an activation element on the auxiliary device) or automatically (e.g. when the listening device and the auxiliary device are brought in electrical contact with each other or in close proximity of each other).

In an embodiment, the listening device is adapted to implement a hearing instrument (comprising algorithms for providing a frequency dependent gain to an input signal according to a user's hearing impairment). In an embodiment, the listening device is adapted to implement a headset (comprising an audio input received from a remote device and adapted to transmit an own voice signal picked up by a microphone of the listening device to a remote device).

In an embodiment, the auxiliary device (AuxD) is integrated with a charging station for charging a rechargeable battery of the listening device (LD). In an embodiment, the system is adapted to transfer a signal representative of the present time from the charging station to the listening device when the listening device (or devices in case of a binaural system) is connected to the charging station, e.g. when the battery of the listening device has been fully charged and/or when the listening device is being removed from the charging station.

In an embodiment, the auxiliary device (AuxD) is integrated with a storage box for the listening device(s) (LD). In an embodiment, the storage box and a charging station are integrated. In an embodiment, the system is adapted to transfer a signal representative of the present time from the storage box to the listening device(s) when the listening device(s) is/are located in the storage box, or when the listening device is being removed from the storage box.

In an embodiment, the auxiliary device (AuxD) is integrated with a remote control for the listening device. In an embodiment, the system is adapted to transfer a signal representative of the present time from the remote control to the listening device on a user's initiative (e.g. by pressing a button on the remote control). In an embodiment, the system is adapted to transfer a signal representative of the present time from the remote control to the listening device every time the listening device is turned on (powered up).

Figure 2:
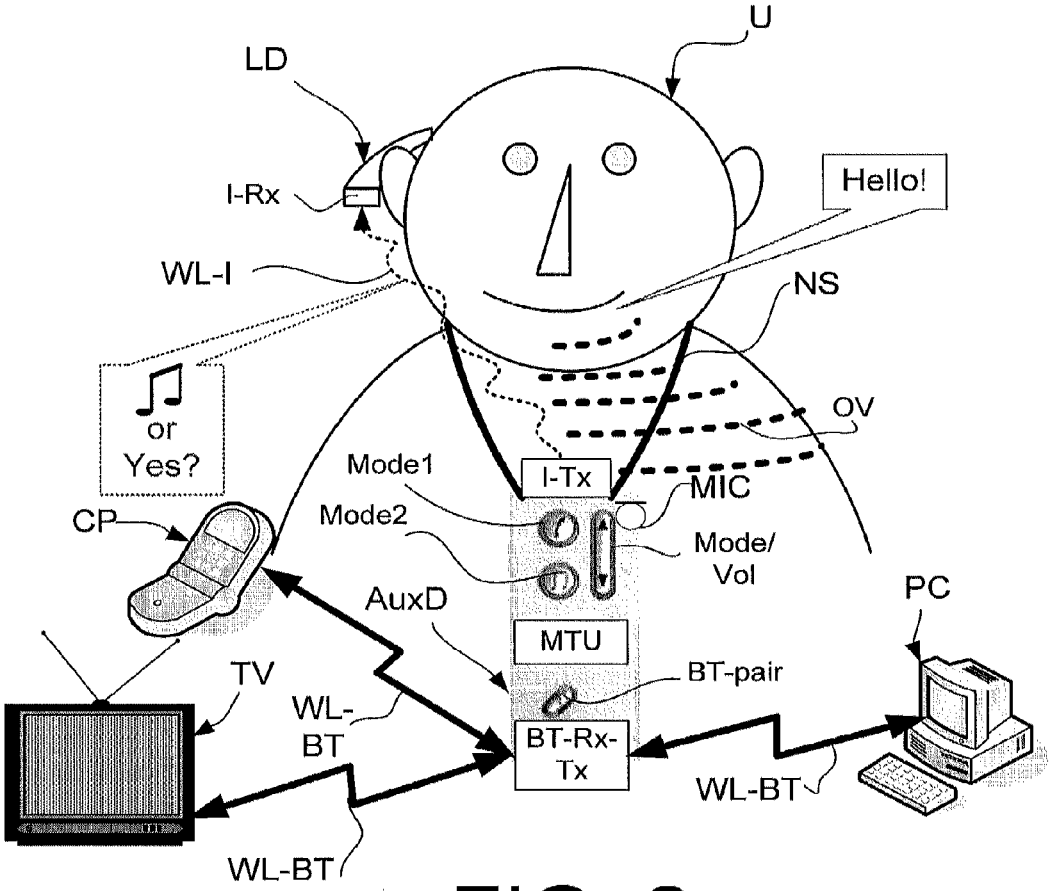
FIG. 2 shows a second embodiment a system according to the present disclosure, a listening system comprising a listening device and an audio gateway, the system being adapted for establishing a communication link between the two devices.

FIG. 2 shows a second embodiment a system according to the present disclosure, a listening system comprising a listening device (LD) and auxiliary device (AuxD), the system being adapted for establishing a communication link (WL-I) between the two devices. The auxiliary device (AuxD) comprises an audio selection device adapted for receiving a multitude of audio signals (here shown from an entertainment device, e.g. a TV-set (TV), a telephone apparatus, e.g. a cell phone (CP) and a computer, e.g. a personal computer (PC)). In the embodiment of FIG. 2, the microphone (MIC) of the audio gateway device is adapted for picking up the user's own voice and capable of being connected to one or more of the external audio sources (TV, CP, PC) via wireless links (WL-BT), here in the form of digital transmission links according to the Bluetooth standard as indicated by the Bluetooth transceiver (BT-Tx-Rx) in the audio gateway device (AuxD). The audio sources and the audio gateway device may be paired or matched using a button (BT-pair) on the audio gateway device. Once paired, the BlueTooth-address of the audio source may be stored in a memory of the audio gateway device for easy future pairing. The links may alternatively be implemented in any other convenient wireless and/or wired manner, and according to any appropriate transmission standard, possibly different for different audio sources. Other audio sources than the ones shown in FIG. 2 may be connectable to the audio gateway, e.g. an audio delivery device (such as a music player or the like). The audio gateway device further comprises a selector/combiner unit (not shown in FIG. 2) adapted for allowing a selection of an appropriate signal or a combination of signals for transmission to the listening device (LD). The intended mode of operation of the listening system can be selected by the user via mode selection buttons Mode1 and Mode2. Here Mode1 indicates e.g. a telephone conversation mode (where the audio signal from a currently actively paired cellular telephone is selected) and Mode2 indicates e.g. an entertainment device mode (where the audio signal from a currently actively paired entertainment device, e.g. the TV-set or a music player, is selected). The particular selected mode determines the signals to be selected/combined in the selector/combiner unit for transmission to the listening device. In Model, the incoming signal from the mobile telephone is transmitted to the listening device (optionally combined with an own voice signal picked up by microphone MIC). In Mode2, the audio signal from an entertainment device is selected and transmitted to the listening device. The audio gateway device comprises a further mode or volume selection button (Mode/Vol) for adjusting a volume of the transmitted audio signal in the listening device. In an embodiment, the system is adapted to provide that a transfer of the signal representative of the present time from the audio gateway device to the listening device can be initiated by the user (U) via a user interface of the audio gateway device, e.g. by pressing the mode or volume selection button (Mode/Vol), e.g. for a predefined (relatively long) time (e.g. >5 s).

The audio gateway device (AuxD) comprises a master timing unit (MTU) adapted for providing (e.g. generating or receiving from another device) a signal representative of the current date and time. In an embodiment, the audio gateway device is adapted to receive timing information from another device, e.g. from one of the audio sources connected or connectable to the audio gateway device (e.g. a cell phone or a TV-set or a personal computer) and to base its transmission of a signal representative of the present time to the listening device on the received timing information. In an embodiment, a the system is adapted to transmit a signal representative of the present time to the listening device every time the audio gateway is connected to the cellular telephone (e.g. every time a telephone call is established via the audio gateway).

The listening device (LD) is shown as a device mounted at the ear of a user (U), e.g. representing a hearing aid. The listening device (LD) of the embodiment of FIG. 2 comprises a wireless transceiver, here indicated to be based on inductive communication (I-Rx). The transceiver (at least) comprises an inductive receiver (i.e. an inductive coil, which is inductively coupled to a corresponding coil in a transceiver (I-Tx) of the audio gateway device AuxD), which is adapted to receive the audio signal from the audio gateway device (either as a baseband signal or as a modulated (analogue or digital) signal, and in the latter case to extract the audio signal from the modulated signal). The inductive link (WL-I) between the audio gateway device and the listening device is indicated to be one-way, but may alternatively be two-way (e.g. to be able to exchange control signals between transmitting and receiving devices, e.g. to agree on an appropriate transmission channel). The listening device is adapted to extract the signal representative of the present time from the wireless signal received from the auxiliary device (audio gateway). The signal representative of the present time may e.g. be embedded in an audio signal (e.g. in a status packet transmitted with the audio signal).

The audio gateway device (AuxD) is shown to be carried around the neck of the user (U) in a neck-strap (NS). The neck-strap (NS) may have the combined function of a carrying strap and a loop antenna into which the audio signal from the audio gateway device is fed for better inductive coupling to the inductive transceiver of the listening device. An audio selection device, which may be modified and used according to the present invention is e.g. described in EP 1 981 253 A1 and in WO 2009/135872 A1.

Figure 3:
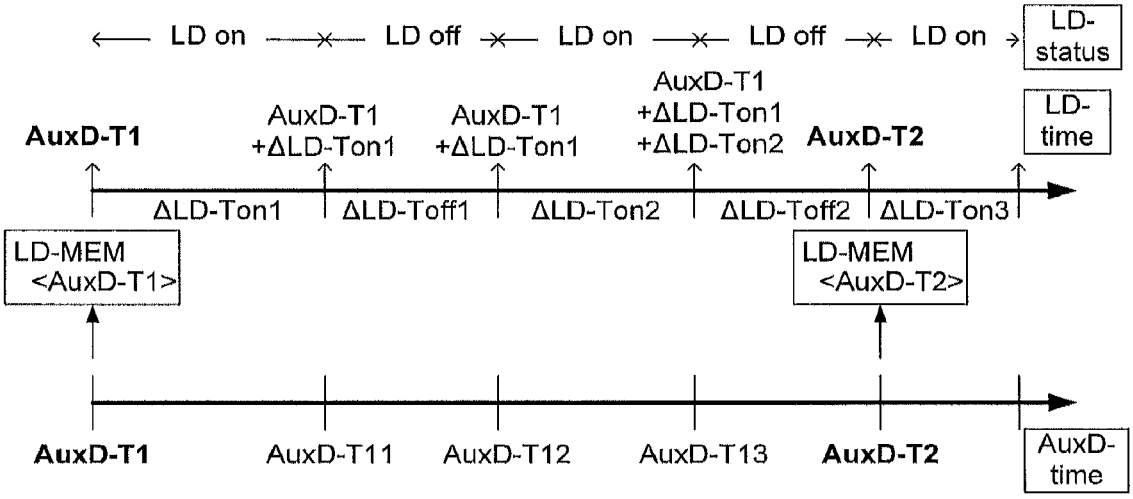
FIG. 3 shows an example of an estimate of absolute time in a system according to the present disclosure.

FIG. 3 shows an example of an estimate of absolute time in a system according to the present disclosure. The lower bold horizontal line represents a time line (AuxD-Time) of the auxiliary device (assumed to have knowledge of the current time with a certain accuracy). The upper bold horizontal line represents a time line (LD-Time) of the portable electronic device. The portable electronic device is assumed to be alternately in an on-state and an off-state as exemplified by the time periods on the time line (LD-Time) of the portable electronic device, and as indicated by the status indications (LD-Status) LD on and LD off, respectively, in the top part of FIG. 3. FIG. 3 assumes a transfer of a signal representative of the present time to be transmitted from the auxiliary device to the portable device (and stored in the memory) at times AuxD-T1 and AuxD-T2, respectively, whereby the portable device at these points in time has an updated (precise) knowledge of the correct time. These instances in time are indicated by bold face (cf. AuxD-T1 and AuxD-T2 in FIG. 3). Immediately after these instances in time (e.g. at AuxD-T2 in the example of FIG. 3), as long as the device has not yet been turned off, the portable electronic device is able to calculate time intervals relative to a previously stored value of the current time (e.g. AuxD-T1 in the example of FIG. 3) with a relatively high precision (and does not have to rely on assumptions concerning the fraction of time where the device has been turned off). The precision is increasingly decreased, when the device is turned off one or more times before an update of the current time is received from the auxiliary device. In the example of FIG. 3, the time determined by the portable electronic device immediately before the update of the present time at AuxD-T2 is TLD(AuxD-T2÷)=AuxD-T1+ΔLD-Ton1+ΔLD-Ton2. In reality the time is AuxD-T2=AuxD-T1+ΔLD-Ton1+ΔLD-Toff1+ΔLD -Ton2+ΔLD-Toff2. In other words, the precision decreases the more off-periods occurring between updates of the present time in the portable electronic device and the longer these off-periods are (hence the decrease in precision is unknown).

In a preferred embodiment, the present time is updated after each off-period in the portable electronic device. This can conveniently be performed during a power-on procedure where the portable listening device is in communication with the auxiliary device, e.g. in a charging station or a storage box or in connection with a remote control or an audio gateway device.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

The invention claimed is:

1. A system comprising a portable electronic device and an auxiliary device, the portable electronic device and the auxiliary device each comprising an interface allowing the establishment of a communication link between them, at least to be able to transmit data representative of a status information from the auxiliary device to the portable electronic device, wherein the portable electronic device comprises a timing unit for determining a time interval and a memory for storing data, wherein a reference start time is stored, and the portable electronic device is further adapted for monitoring and storing an operating time from a power-on-time to a power-off-time of operation of the portable electronic device, and wherein the auxiliary device comprises a master timing unit for providing a signal representative of the present time, and wherein the system is adapted to transfer said signal representative of the present time from the auxiliary device to the portable electronic device and to store it in said memory when the portable electronic device is connected to the auxiliary device or at the request of a user, whereby the daily use and non-use pattern of the portable electronic device can be estimated the portable electronic device including a measure of the absolute time elapsed from said reference start time.

2. A system according to claim 1 adapted to provide that a linking procedure of the communication link between the auxiliary and portable electronic device comprises an identification of a predefined security key in at least one of the devices.

3. A system according to claim 1 wherein the portable electronic device is adapted to estimate an absolute time span wherein the portable electronic device has been in a non-operational state from a given absolute point in time and from an estimate of the accumulated time of operation of the portable electronic device relative to said given absolute point in time.

4. A system according to claim 1 wherein the auxiliary device is or form part of a device selected from the group comprising a communication device, e.g. a cell phone or an FM transmitter, an audio gateway device, a battery charger, a storage box for the portable electronic device, a remote control for the portable electronic device, or other device which the portable electronic device is expected to occasionally encounter.

5. A system according to claim 1 adapted to provide that the portable electronic device receives the signal representative of the present time from the auxiliary device via an intermediate device.

6. A system according to claim 1 wherein the portable electronic device comprises a listening device.

7. A system according to claim 1 adapted for providing a timing input to algorithms or detectors needing information about elapsed time extending over more than a time of operation of the portable electronic device, e.g. more than 8 hours or more than one day.

8. A system according to claim 1 wherein the portable electronic device comprises a directional microphone system comprising an algorithm for matching the two or more microphones as a function of time, and wherein the algorithm for matching the two or more microphones is adapted to receive a measure of the absolute time elapsed from a given start time.

9. A system according to claim 1 wherein the portable electronic device comprises an algorithm for estimating a parameter related to the growth of an ear canal of a child over time to estimate points in time, where a modification of parameters of the portable electronic device is appropriate based on a measure from said timing unit of the absolute time elapsed from a given start time.

10. A system according to claim 9 wherein the algorithm for estimating the growth of an ear canal of the child over time is used to estimate a parameter related to leakage of sound from an output transducer to an input transducer of the portable electronic device.

11. A system according to claim 1 wherein the portable electronic device is adapted to issue an alarm signal when a predefined time has elapsed since a given absolute point in time.

12. A system according to claim 1 wherein the auxiliary device comprises a display and is adapted to show the present time generated or received by the auxiliary device in the display.

13. A system according to claim 1 wherein the portable electronic device comprises a display and is adapted to show an estimate of the present time based on a signal representative of the present time received from the auxiliary device.

14. A system according to claim 1 wherein the portable electronic device is adapted to display an estimate of the relative operating time of the portable electronic device.

15. A method of establishing a measure of an absolute elapsed time in a portable electronic device, the portable electronic device forming part of a system comprising the portable electronic device and an auxiliary device, the portable electronic device and the auxiliary device each comprising an interface allowing the establishment of a communication link between them, at least to be able to transmit data representative of a status information from the auxiliary device to the portable electronic device, the method comprising storing a reference start time in the portable electronic device;

providing in the auxiliary device a signal representative of the present time;

transmitting said signal representative of the present time to the portable electronic device;

receiving said signal representative of the present time in the portable electronic device when the portable electronic device is connected to the auxiliary device or at the request of a user;

extracting and storing data representative of the present time in the portable electronic device;

monitoring and storing an operating time from a power-on-time to a power-off-time of operation of the portable electronic device;

determining in the portable electronic device an absolute time interval based on said data representative of the present time received from the auxiliary device and/or said reference start time, including the determination of a measure of the absolute time elapsed from said reference start time.

16. A method according to claim 15 comprising determining an accumulated operating time as a sum of individual operating times from a measurement start time, e.g. said reference start time, to a later time, e.g. said present time.

17. A method according to claim 16 comprising determining an accumulated non-operating time from said accumulated operating time, said measurement start time and said later time, e.g. said data representative of the present time.

18. A method according to claim 17 comprising determining a relative operating time as the accumulated operating time over said absolute time interval divided by said absolute time interval.

19. A method according to claim 18 comprising determining a usage pattern of a particular user of the portable electronic device by determining a relative operating time on a daily basis.

20. A method according to claim 15 comprising modifying one or more parameter settings of one or more algorithms in the portable electronic device based on the determined usage pattern and/or on said absolute elapsed time.

* * * * *